United States Patent [19]

Hiraki

[11] Patent Number: 4,794,679

[45] Date of Patent: Jan. 3, 1989

[54] METHOD OF AND APPARATUS FOR SIZING AND DRYING WARPS OF FILAMENT YARNS

[75] Inventor: Toshitsuyo Hiraki, Nagoya, Japan

[73] Assignee: Kawamoto Industrial Co., Ltd., Nagoya, Japan

[21] Appl. No.: 19,615

[22] Filed: Feb. 27, 1987

[30] Foreign Application Priority Data

Mar. 11, 1986 [JP] Japan ..... 61-53326

[51] Int. Cl.[4] ..... D02H 5/02

[52] U.S. Cl. ..... 28/181

[58] Field of Search ..... 28/180, 181

[56] References Cited

U.S. PATENT DOCUMENTS

| | | | |
|---|---|---|---|
| 2,675,601 | 4/1954 | Still | 28/180 |
| 3,406,437 | 10/1968 | Tew | 28/180 |
| 3,449,808 | 6/1969 | Kuroda | 28/180 |
| 3,466,717 | 9/1969 | Kuroda | 28/180 |
| 4,025,993 | 5/1977 | Kuroda | 28/181 |
| 4,417,374 | 11/1983 | Kuroda et al. | 28/181 |
| 4,458,397 | 7/1984 | Kuroda et al. | 28/181 |

FOREIGN PATENT DOCUMENTS

| | | | |
|---|---|---|---|
| 4730734 | 8/1972 | Japan | 28/179 |
| 1016597 | 1/1966 | United Kingdom . | |

*Primary Examiner*—Robert R. Mackey

*Attorney, Agent, or Firm*—Wegner & Bretschneider

[57] ABSTRACT

A method of and an apparatus for simultaneous sizing and drying a complete number of warps of filament yarns required for weaving of cloth. During sizing, a warp sheet having high yarn density is put to uniform arrangement state using a first slant reed and a guide roller, and the warp sheet in the uniform arrangement state passes through a sizing solution and is squeezed at high pressure. The sized yarns are separated using dividing rods and a second upright reed before preparatory drying, and separated using a third upright reed and dividing rods after the preparatory drying, thereby the sized yarns in separated state in vertical and lateral directions pass through hot air during the preparatory drying. Yarns separated after the preparatory drying are put to uniform arrangement state using a fourth slant reed and a guide roller, and the yarns in the uniform arrangement state are laid over heating cylinders during finishing drying.

6 Claims, 4 Drawing Sheets

METHOD OF AND APPARATUS FOR SIZING AND DRYING WARPS OF FILAMENT YARNS

BACKGROUND OF THE INVENTION

The present invention relates to a method of and an apparatus for simultaneous sizing and drying a complete number of warps of filament yarns required for weaving of cloth.

FIRST EXAMPLE OF THE PRIOR ART

In such technology of the prior art as disclosed in U.S. Pat. No. 3,449,808, a complete number of warps of filament yarns required for weaving of cloth are drawn from a necessary number of warper's beams, and the warp sheets from each warper's beam are collected into one complete sheet. The complete warp sheet passes through a sizing solution and is squeezed, that is, it is sized, and then it is separated into separate warp sheets of the original warper's beams to be transferred into a hot air drying chamber. Each warp sheet is laid over a dividing roller installed within the drying chamber, and each warp sheet in vertically separated state passes through the drying chamber and is dried by hot air. Then, dried warp sheets are collected into one warp sheet again outside the hot air drying chamber, and the warp sheet is finally wound into a loom beam.

However, this method of the prior art has problems as follows:

(1) Since the yarn density of the warp sheet is high during sizing, the amount of sizing agent coated to the yarns is insufficient and yarn filaments are not strongly bound with each other.

In order to increase the coating amount of the sizing agent, a sizing solution of high concentration is used.

However, the sizing solution of high concentration has high viscosity. In the prior art, since squeezing is performed at low pressure of 1.5 kg or less per 1 cm of the warp sheet in the width direction, if the sizing solution of high concentration is used, the squeezing becomes insufficient and the sizing solution does not sufficiently penetrate to inside of the yarn but adheres excessively on the yarn surface.

Thus the sizing is not performed well.

(2) Since each warp sheet passes over a dividing roller within the hot air drying chamber during the drying process, yarns with sizing agent in semi-dried state are slidably contacted with the dividing roller and the semi-dried sizing agent coated to the yarns is rubbed off and adheres to the dividing roller, thereby the sizing agent layer covering the yarns becomes uneven and the sizing agent which adheres to the dividing rollers is solidified into waste-size. Consequently, the warp sheet is not divided smoothly on account of the waste-size which adheres to the dividing rollers. Moreover, the waste-size on the dividing rollers adheres to yarns with semi-dried sizing agent when the yarns pass through the dividing rollers.

Thus, the drying is not performed well.

In conclusion, in the first example of the prior art, warps which are sized and dried at high quality cannot be obtained.

SECOND EXAMPLE OF THE PRIOR ART

In order to solve the problems in the above-mentioned first example of the prior art, warp sizing and drying technology in plural yarn path systems have been developed.

In this technology as disclosed in U.S. Pat. No. 4,417,374 and U.S. Pat. No. 4,458,397, a set of warper's beams with a necessary number to obtain a complete number of warps of filament yarns required for weaving of cloth is divided in two or three systems according to the complete number of warps and the yarn diameter so that warps wound on a plurality of warper's beams of each system are arranged at the width of the warper's beam and at the yarn pitch of three times the yarn diameter or more. The plurality of the warper's beams of each system are set to each of two or three warp sizing and drying mechanisms arranged in vertical levels. In each system, warp sheets drawn from the warper's beams are collected into one warp sheet having the width of the warper's beam, and the collected warp sheet is sized. The sized warp sheet is divided into the original warp sheets of the warper's beams, and each of the divided warp sheets is again divided into several divided warp sheets. Thus the sized yarns are separated in vertical and lateral directions, and the sized yarns in separate state are predried by hot air. The predried yarns are collected into one warp sheet, and the collected warp sheet is finish-dried by heating cylinders. Warp sheets finish-dried in respective systems are collected into one warp sheet having width of the loom beam, and the complete warp sheet is would on the loom beam.

However, this prior art has the following problems:

(1) Since the warp sheet is not separated into individual yarns after preparatory drying, adjacent yarns are liable to be contacted and overlapped and liable to adhere. Snarling is also is liable to occur during finishing drying.

(2) Since the two or three warp sizing and drying mechanisms are arranged in vertical levels, the operator must move up and down to the second floor or the third floor thus, a significant amount of labor is required for the preparatory operation to set warps or the control thereof during the working operation.

Since the warp sizing and drying mechanisms have a structure of two stories or three stories, the cost of equipment is very high and the energy consumption is very high.

In conclusion, in the second example of the prior art, warps which are sized and dried with high quality cannot be manufactured efficiently at low cost.

SUMMARY OF THE INVENTION

An object of the invention is to provide a method of and an apparatus for sizing and drying warps of filament yarns wherein the above-mentioned disadvantages in both examples of the prior art are eliminated, and sized and dried warps with high quality can be manufactured efficiently at low cost.

In order to attain the above object, the inventor has first noticed that the first example of the prior art has higher productivity than the second example of the prior art, and that the second example can obtain the sized and dried warps with higher quality than that of the first example. In order to increase the productivity, the warp sizing and drying path is constituted in one system as seen in the first example, and in order to obtain the sized and dried warps with high quality, the warp sizing and drying path in the one system is constituted in similar manner to that seen in the second example.

Next, the above-mentioned warp sizing and drying path in the one system has been improved in the following points:

(1) During sizing, a warp sheet having high yarn density is put to uniform arrangement state using a first slant reed and a guide roller, and the warp sheet in uniform arrangement state passes through a sizing solution and is squeezed at high pressure of 4 kg or more per cm in the width direction of the warp sheet.

Then, although the warp sheet to be sized has high yarn density, the sizing solution permeates the yarn well and yarn filaments are strongly bound with each other and the lack of sizing is not produced. Furthermore, the sizing agent does not adhere excessively on the yarn surface. Consequently, the sizing is performed well.

When the warp sheet in the uniform arrangement state is squeezed at high pressure, water content in the sized yarn becomes less, thereby the sized yarn can be dried rapidly during drying at the subsequent process and the consumption amount of heat energy becomes less. Furthermore, since the yarn drying is rapid, even if yarns are contacted with each other they are not liable to adhere thereby separation spacing of yarns during drying may be shortened. Moreover, the sizing agent adhered to the yarn is rapidly solidified and therefore not liable to adhere to the reed, the guide roller or the like.

(2) The sized yarns are separated using dividing rods and a second upright reed before preparatory drying, and separated using a third upright reed and dividing rods after the preparatory drying, thereby the sized yarns in completely separated state in vertical and lateral directions pass through hot air during the preparatory drying.

Then, although the sized yarns to be predried are large in number, permeability of hot air is good to the sized yarn group having little water content due to the high pressure squeezing thereby the sized yarns can be dried well. Moreover, yarns neither adhere nor tangle with each other during the preparatory drying. Consequently, the preparatory drying can be effected well.

(3) Yarns separated after the preparatory drying are put to uniform arrangement state (i.e., yarns of a warp sheet are arranged or disposed at a uniform pitch or spacing) using a fourth slant reed and a guide roller, and the yarns in the uniform arrangement state are laid over the heating cylinders during finishing drying.

Then, although the warp sheet to be finish-dried has high yarn density, adhesion or snarling of adjacent yarns is not liable to be produced thereby the yarns can be dried well.

As clearly understood from the above description, the invention consists in a method of sizing and drying warps of filament yarns, comprising:

step of drawing a complete number of warps of filament yarns required for weaving of cloth from a necessary number of warper's beams;

step of collecting warp sheets drawn from each warper's beam into one warp sheet having a width of the warper's beam on a guide roller by passing yarns of each warp sheet one by one between needles of a first slant reed, and of sizing by passing the collected warp sheet through a sizing solution and squeezing it at high pressure;

step of dividing the sized and collected warp sheet vertically into warp sheets with a number 2~4 times that of the number of warper's beams by dividing each warp sheet of the warper's beam vertically into 2~4 sheets, and of passing yarns of each warper's beam by 2~4 yarns at a time between needles of a second upright reed having a needle pitch 2~4 times that of the first slant reed and separating the sized yarns in vertical and lateral directions;

step of preparatory drying the sized yarns in separate state by hot air;

step of dividing the predried yarns vertically into warp sheets per the number of warper's beams by passing yarns of each warper's beam one by one between needles of a third upright reed having a needle pitch equal to that of the first slant reed;

step of collecting the warp sheets of each warper's beam into one warp sheet having a width of the warper's beam on a guide roller by passing yarns of each warp sheet one by one between needles of a fourth slant reed having a needle pitch equal to that of the first slant reed, and of finish-drying the collected warp sheet by heating cylinders; and step of dividing the finish-dried and collected warp sheet vertically into warp sheets per the number of warper's beams, and of collecting warp sheets of each warper's beam into one warp sheet having a width of a loom beam on a roller by passing yarns of each warp sheet one by one between needles of a fifth reed, and of winding the collected warp sheet onto the loom beam.

According to this method, sized and dried warps with high quality can be manufactured efficiently at low cost.

The invention also consists of an apparatus for sizing and drying warps of filament yarns, which is composed of a beam stand section, a sizing section, a preparatory drying section, a finishing drying section and a winding section, arranged in sequence in the travelling direction of warps, the beam stand section comprising beam stands for setting warper's beams with a necessary number to draw a complete number of warps of filament yarns required for weaving of cloth;

the sizing section comprising a first slant reed having a needle pitch equal to the yarn pitch of the warper's beam, a guide roller, and a sizing device provided with a size box, an immersion roller and high pressure squeezing rollers, all installed in front of the beam stands in sequence;

the preparatory drying section comprising an inlet dividing part provided with dividing rods having a necessary number to divide the sized warp sheet vertically into warp sheets having a number 2~4 times that of the number of the warper's beams and a second upright reed having a needle pitch 2~4 times that of the first slant reed, a hot air drying chamber through which the sized yarns in separate state pass, and an outlet dividing part provided with a third upright reed having a needle pitch equal to that of the first slant reed and dividing rods having a necessary number to divide the hot-air dried yarns vertically into warp sheets per the number of warper's beams, all installed in front of the sizing device in sequence;

the finishing drying section comprising a fourth slant reed having a needle pitch equal to that of the first slant reed, a guide roller, and a cylinder drying device, all installed in front of the outlet dividing part in sequence; and the winding section comprising dividing rods having a necessary number to divide the finish-dried warp sheets vertically into warp sheets per warper's beam, a fifth reed to adjust the warp sheets to width of a loom beam, a roller, and a winding device to set the loom beam, all installed in front of the cylinder drying device in sequence.

This apparatus can implement the above-mentioned method of the invention, and can manufacture the sized and dried warps with high quality efficiently at low cost.

DETAILED DESCRIPTION OF THE PREFERRED EMBODIMENT

Figure 1:
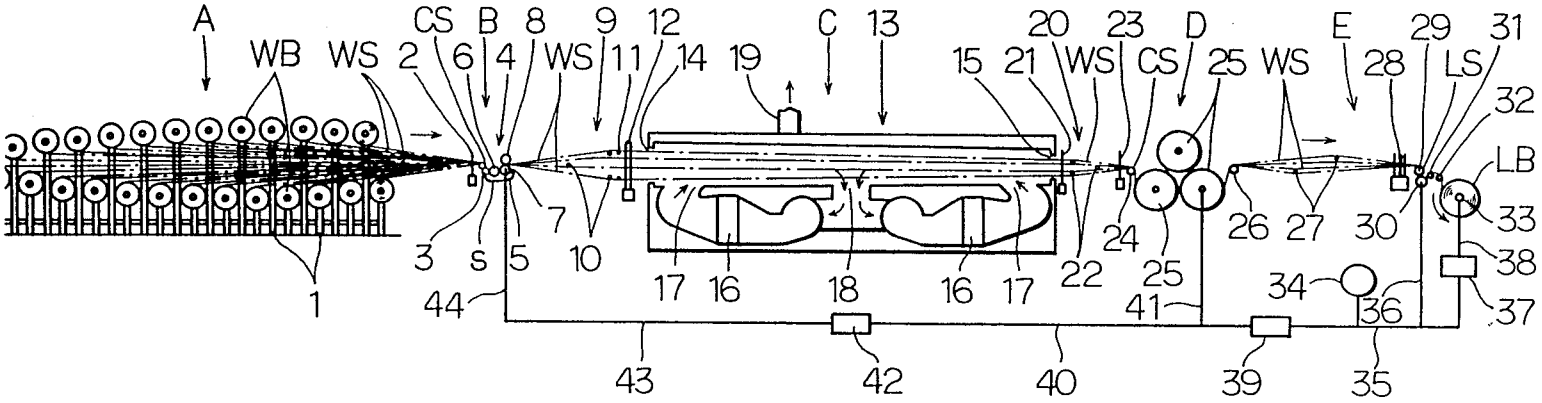
FIG. 1 is a schematic side view of an apparatus for sizing and drying warps of filament yarns as an embodiment of the invention.

An apparatus for sizing and drying warps of filament yarns as an embodiment of the invention comprises a beam stand section (A), a sizing section (B), a preparatory drying section (C), a finishing drying section (D) and a winding section (E) arranged in sequence in the travelling direction of warps as shown in FIG. 1.

In the beam stand section (A) at the rear stage, as shown in FIG. 1, beam stands 1 are installed so that warper's beams (WB) with a necessary number to draw a complete number of warps of filament yarns required for weaving of cloth are set in vertical and horizontal directions, and each beam stand 1 is provided with a yarn tension controller (not shown).

Figure 2:
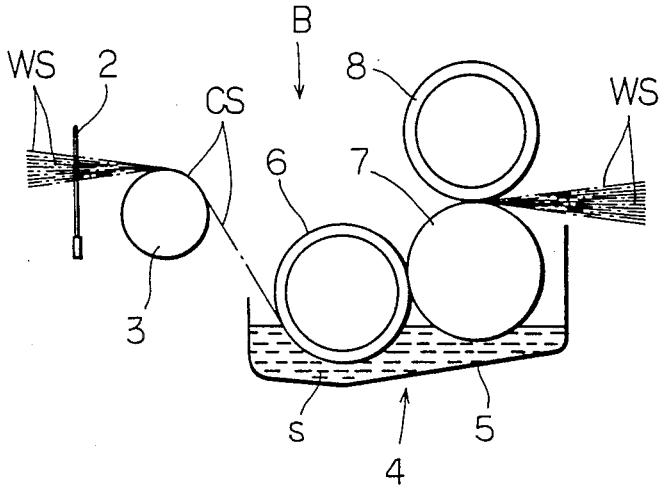
FIG. 2 is a schematic enlarged side view of a sizing section of the apparatus.

In the sizing section (B), as shown in FIG. 1 and FIG. 2, a first slant reed 2 having a needle pitch equal to the yarn pitch of the warper's beam (WB) is installed in front of the beam stand 1, and a first guide roller 3 is installed in front of the first slant reed 2. A sizing device 4 is installed in front of the first guide roller 3. The sizing device 4 comprises a size box 5, an immersion roller 6 immersed nearly halfway in a sizing solution (s) within the size box 5, and high pressure squeezing rollers 7, 8, composed of a bottom squeezing roller 7 abutting on the front side of the immersion roller 6 and a top squeezing roller 8 abutting on the top side of the bottom squeezing roller 7.

The preparatory drying section (C) is composed of an inlet dividing part 9, a hot air drying chamber 13 and an outlet dividing part 20.

Figure 3:
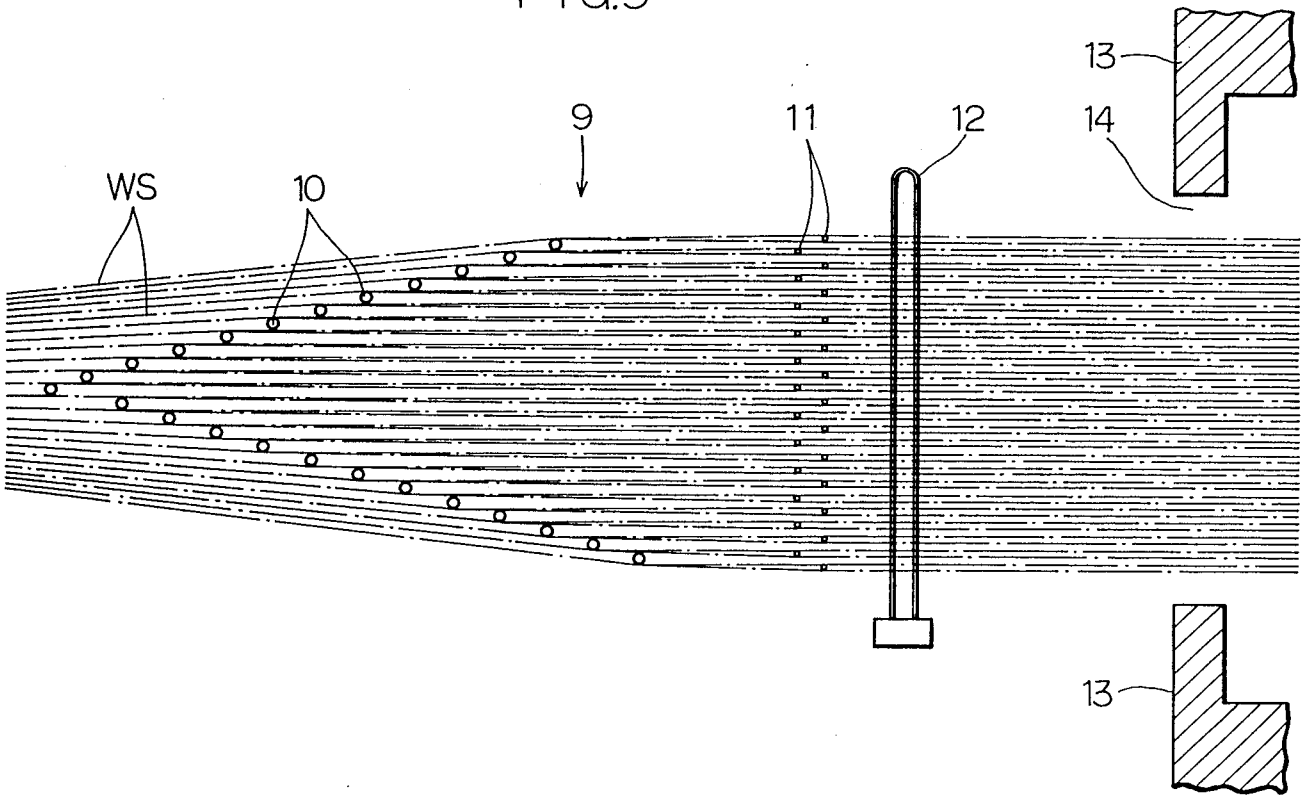
FIG. 3 is a schematic enlarged side view of an inlet dividing part of a preparatory drying section of the apparatus.

In the inlet dividing part 9, as shown in FIG. 1 and FIG. 3, first dividing rods 10 with a necessary number to divide sized warp sheet (CS) vertically into warp sheets (WS) per the warper's beams (WB), and second dividing rods 11 with a necessary number to divide each warp sheet (WS) per the warper's beam (WB) vertically into two sheets are installed in front of the sizing device 4. A second upright reed 12 being tall and having a needle pitch of twice that of the first slant reed 2 is installed between the second dividing rods 11 and an inlet opening 14 of the hot air drying chamber 13.

In the hot air drying chamber 13, as shown in FIG.1, the inlet opening 14 is provided at a rear wall, and an outlet opening 15 is provided at a front wall. Hot air generating devices 16 are installed respectively at rear side and front side under the floor, and blow mouths 17 of the hot air generating devices 16 are opened respectively n the rear end and the front end of the floor towards the center portion of the ceiling. A suction mouth 18 common to both hot air generating devices 16 is opened on the center of the floor, and an exhaust pipe 19 to exhaust a part of the hot air is installed on the ceiling.

Figure 4:
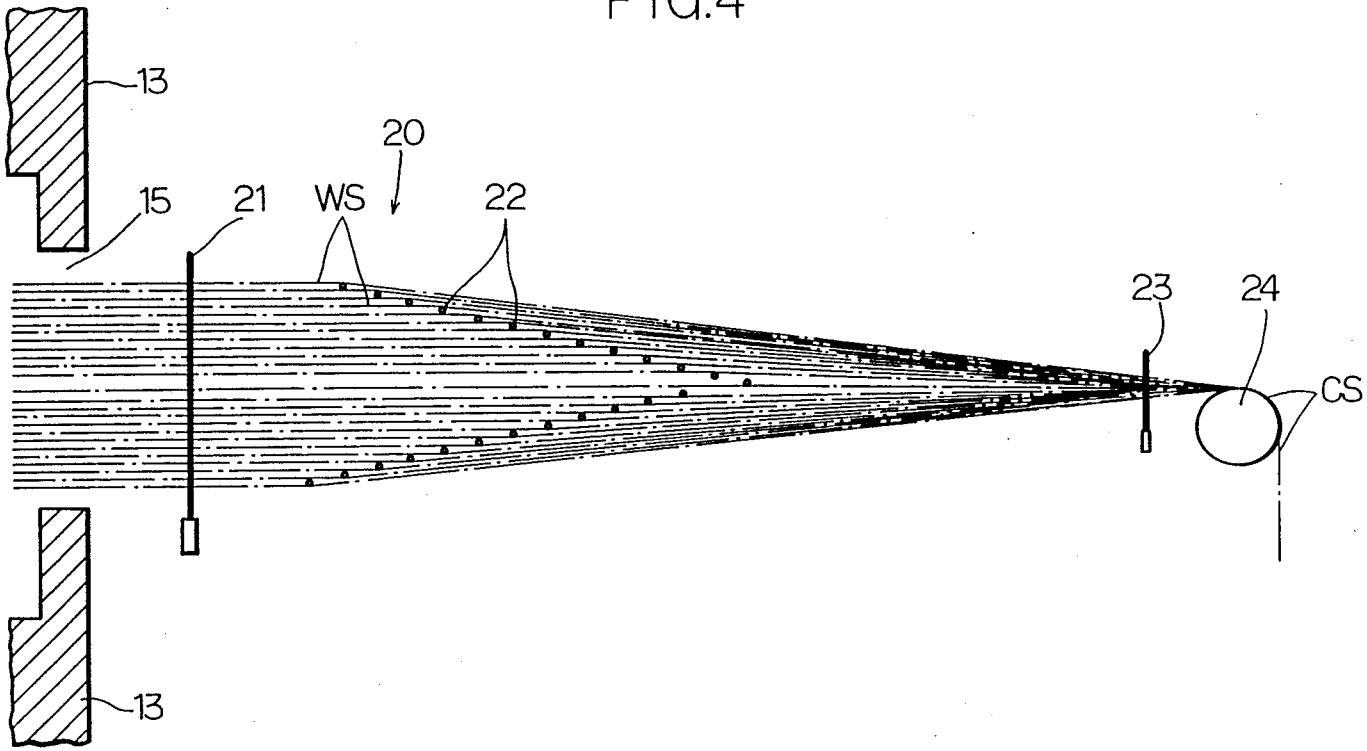
FIG. 4 is a schematic enlarged side view of an outlet dividing part of the preparatory drying section of the apparatus.

In the outlet dividing part 20, as shown in FIG. 1 and FIG. 4, a third upright reed 21 being tall and having a needle pitch equal to the first slant reed 2 is installed in front of the outlet opening 15 of the hot air drying chamber 13, and third dividing rods 22 with a necessary number to divide the hot-air dried yarns vertically into warp sheets (WS) per the warper's beams are installed in front of the third upright reed 21.

In the finishing drying section (D), as shown in FIG. 1 and FIG. 4, a fourth slant reed 23 having a needle pitch equal to the first slant reed 2 is installed in front of the third dividing rods 22, and a second guide roller 24 is installed in front of the fourth slant reed 23. A cylinder drying device 25 composed of a plurality of heating cylinders is installed in front of the second guide roller 24, and a third guide roller 26 is installed in front of the cylinder drying device 25.

Each of the first and fourth slant reeds 2, 23 comprises many needles which are mounted in regular intervals on a slender base stand and arranged slantwise in equal angle to one end of the base stand.

Each of the second and third upright reeds 12, 21 comprises many needles which are mounted in regular intervals on a slender base stand and arranged vertically.

In the winding section (E), as shown in FIG. 1, fourth dividing rods 27 with a necessary number to divide the finish-dried warp sheets vertically into the warp sheets (WS) per the warper's beams are installed in front of the third guide roller 26, and a fifth adjustable reed 28 of zigzag form to adjust the warp sheets into the width of loom beam (LB) is installed in front of the fourth dividing rods 27. A measuring roller 29 is installed in front of the fifth reed 28, and a beaming roller 30 is installed on the bottom side of the measuring roller 29. A fourth guide roller 31 and a fifth guide roller 32 are installed on the front side of the beaming roller 30, and a winding device 33 to set the loom beam (LB) is installed on the front side of the fifth guide roller 32.

As shown in FIG. 1, a driving shaft 36 of the beaming roller 30 is connected to a first transmitting shaft 35 connected to a motor 34. A driving shaft 38 of the winding device 33 is also connected to the first transmitting shaft 35 through a winding speed changing device 37, and further a second transmitting shaft 40 is connected thereto through a first draft adjusting device 39. A driving shaft 41 of the heating cylinder 25 on the front end of the finishing drying section (D) is connected to second transmitting shaft 40, and a third transmitting shaft 43 is connected thereto through a second draft adjusting device 42. A driving shaft 44 of the bottom squeezing roller 7 of the sizing section (B) is connected to third transmitting shaft 43.

In order to perform a method of sizing and drying warps of filament yarns using the above-mentioned apparatus for sizing and drying warps of the embodiment, as shown in FIG. 1, the warper's beams (WB) with a necessary number to draw a complete number of warps of filament yarns required for weaving of cloth are set to the beam stands 1, and the warps of filament yarns such as acetate yarns, rayon yarns, polyester yarns or nylon yarns are drawn in sheet form from each warper's beam (WB).

Yarns of each warp sheet (WS) drawn from each warper's beam (WB) pass between needles of the first slant reed 2 "one by one" (i.e., only one yarn passes between two adjacent needles), and the warp sheets (WS) are collected into one warp sheet (CS) having a width of the warper's beam (WS) on the first guide roller 3 as shown in FIG. 1 and FIG. 2. The collected warp sheet (CS) passes through the sizing solution (s) within the size box 5 at bottom side of the immersion roller 6, and further passes between the immersion roller 6 and the bottom squeezing roller 7 and between the bottom squeezing roller 7 and the top squeezing roller 8 thereby the squeezing is performed twice. The second squeezing is performed by the high pressure squeezing rollers 7, 8 at high pressure of 4 kg or more per cm in the width direction of the warp sheet (CS). That is, the collected warp sheet (CS) is sized.

As shown in FIG. 1 and FIG. 3, the collected warp sheet (CS) after sizing is divided vertically into warp sheets (WS) per the warper's beams by the first dividing rods 10, and each of the warp sheets (CS) is further divided vertically into two sheets by the second dividing rods 11. Thus the collected warp sheet (CS) after sizing is divided vertically into warp sheets of number being twice that of the number of warper's beams (WB) by the first and second dividing rods 10, 11. Subsequently yarns of each warper's beam (WB) pass by "two at a time" (i.e., two yarns pass between two adjacent needles) between needles of the second upright reed 12 thereby the sized yarns are separated in vertical and lateral directions.

The sized yarns in separate state pass through the hot air drying chamber 13 from the inlet opening 14 to the outlet opening 15 as shown in FIG. 1, and are dried in preparatory drying by the hot air from the blow mouths 17 on the rear end and the front end within the hot air drying chamber 13 during this process.

As shown in FIG. 1 and FIG. 4, the yarns of each warper's beam (WB) after preparatory drying pass between needles of the third upright reed 21 one by one, and are divided vertically into warp sheets (WS) per the warper's beams by the third dividing rods 22.

Yarns of each warp sheet (WS) of each warper's beam pass between needles of the fourth slant reed 23 one by one, and the warp sheets (WS) are collected into one warp sheet (CS) having width of the warper's beam (WS) on the second guide roller 24 as shown in FIG. 1 and FIG. 4. The collected warp sheet (CS) is wound on the plurality of heating cylinders 25 in sequence and dried in finishing drying.

The collected warp sheet (CS) after finishing drying passes through the third guide roller 26, and then is divided vertically into warp sheets (WS) per the warper's beams by the fourth dividing rods 27 as shown in FIG. 1. Yarns of each warp sheet (WS) of each warper's beam pass between needles of the fifth adjustable reed 28 one by one, and the warp sheets (WS) are collected into one warp sheet (LS) having width of the loom beam (LB) on the measuring roller 29. The collected warp sheet (LS) passes through the beaming roller 30, the fourth guide roller 31 and the fifth guide roller 32 in sequence, and is wound on the loom beam (LB) set to the winding device 33.

Further concrete data in the embodiment are as follows:

sort of yarn: acetate yarn, 75 d, 20 f
yarn diameter: 0.11 mm
number of warper's beams: 25
number of warps in one warper's beam: 790
total number of warps: 19,750
warper's beam width: 1,520 mm
needle pitch in 1st, 3rd or 4th reed: 1.92 mm
yarn pitch during sizing: 0.077 mm
travelling speed of warp: 40 m/minute
squeezing pressure: 5.3 kg/cm
squeezing force: 805.6 kg
loom beam width: 1,950 mm Warps after sized and dried in the above-mentioned conditions are set to an air jet loom, and the loom was operated at high weft inserting speed of 500 welts per minute, thereby satin or sateen woven fabric of high quality could be woven at high working efficiency of 96%.

In the embodiment shown in the accompanying drawings, the warper's beams (WB) set to the beam stands 1 are 25 in number. The first and second dividing rods 10, 11 with a necessary number to divide vertically the collected warp sheet (CS) after sizing into warp sheets with a number twice that of the number of the warper's beam (WB), and the second upright reed 12 having a needle pitch twice that of the first slant reed 2 are installed at the inlet dividing part 9. The collected warp sheet (CS) after sizing is divided vertically into warp sheets with a number twice that of the number of the warper's beams (WB), and yarns of each warper's beam (WB) pass by two at a time between needles of the second upright reed 12. When the number of the warper's beams set to the beam stands in less than that in the embodiment, however, the dividing rods with a necessary number to divide vertically the collected warp sheet after sizing into warp sheets with number being three times or four times that of the number of the warper's beams and the second upright reed having a needle pitch being three times or four times that of the first slant reed are installed, thereby the collected warp sheet after sizing is divided vertically into warp sheets with the number being three times or four times that of the number of the warper's beams and yarns of each warper's beam pass by three or four at a time between needles of the second upright reed.

While the invention has been particularly shown and described in reference to preferred embodiments thereof, it will be understood by those skilled in the art that changes in form and details may be made therein without departing from the spirit and scope of the invention.

What I claim is:

1. A method of sizing and drying warps of filament yarns, comprising the steps of:

drawing a complete number of warps of filament yarns required for the weaving of cloth from a number of warper's beams;

collecting warp sheets drawn from each warper's beam into one warp sheet having a width of the warper's beam on a guide roller by passing yarns of each warp sheet one by one between needles of a first slant reed, and of sizing by passing the collected warp sheet through a sizing solution and squeezing it at high pressure;

dividing the sized and collected warp sheet vertically into warp sheets of a number between 2 and 4 times the number of warper's beams by dividing each warp sheet of the warper's beam vertically into a number between 2 and 4, and of passing yarns of each warper's beam by a number between 2 and 4 at a time between needles of a second upright reed having a needle pitch between 2 and 4 times of that of the first slant reed and separating the sized yarns in vertical and lateral directions;

preparatory drying the sized yarns in separated state by hot air;

dividing the predried yarns vertically into warp sheets per the number of warper's beams by passing yarns of each warper's beam one by one between needles of a third upright reed having a needle pitch equal to that of the first slant reed;

collecting the warp sheets of each warper's beam into one warp sheet having a width of the warper's beam on a guide roller by passing yarns of each warp sheet one by one between needles of a fourth slant reed having a needle pitch equal to that of the first slant reed, and of finish-drying the collected warp sheet by heated cylinders; and dividing the finish-dried and collected warp sheet vertically into warp sheets per the number of warper's beams, and of collecting warp sheets of each warper's beam into one warp sheet having a width of a loom beam on a roller by passing yarns of each warp sheet one by one between needles of a fifth reed, and of winding the collected warp sheet onto the loom beam.

2. A method as set forth in claim 1, wherein the sized and collected warp sheet is divided vertically into warp sheets with the number being twice the number of the warper's beams by dividing warp sheets of each warper's beam vertically into two, and yarns of each warper's beam pass by two at a time between needles of said second upright reed having a needle pitch twice that of the first slant reed.

3. A method as set forth in claim 1, wherein the collected warp sheet is in uniform arrangement state during passing through the sizing solution, and pressure to squeeze the collected warp sheet is at least 4 kg. per cm. in the width direction of the collected warp sheet.

4. An apparatus for sizing and drying warps of filament yarns, comprising: a beam stand section; a sizing section; a preparatory drying section; a finishing drying section and a winding section; arranged in sequence in the travelling direction of warp yarns, wherein said beam stand section comprises beam stands for setting warper's beams of a number necessary to draw a complete number of warps of filament yarns required for the weaving of cloth, wherein said sizing section comprises a first slant reed having a needle pitch equal to the yarn pitch of the yarns on the warper's beams, a guide roller, and sizing device provided with a size box, an immersion roller and high pressure squeezing rollers, all installed in front of the beam stand section in sequence, wherein said preparatory drying section comprises an inlet dividing part provided with dividing rods having a number necessary to divide the sized warp sheet vertically into warp sheets of a number between 2 and 4 times the number of the warper's beams and a second upright reed having a needle pitch between 2 and 4 times that of the first slant reed, a hot air drying chamber through which the sized yarns pass in separate state, and an outlet dividing part provided with a third upright reed having a needle pitch equal to that of the first slant reed and dividing rods having a number necessary to divide the hot-air dried yarns vertically into warp sheets per the number of warper's beams, all installed in front of the sizing device in sequence, wherein said finishing drying section comprises a fourth slant reed having a needle pitch equal to that of the first slant reed, a guide roller, and a cylinder drying device, all installed in front of the outlet dividing part in sequence, and wherein said winding section comprises dividing rods having a number necessary to divide the finish-dried warp sheets vertically into warp sheets per the number of warper's beams, a fifth reed to adjust the warp sheets to the width of a loom beam, a roller, and a winding device to set the loom beam, all installed in front of the cylinder drying device in sequence.

5. An apparatus as set forth in claim 4, wherein the dividing rods of the inlet dividing part are of a number necessary to divide the sized warp sheet into warp sheets of a number twice the number of the warper's beams, and the second upright reed has needle pitch twice that of the first slant reed.

6. An apparatus as set forth in claim 4, wherein the squeezing pressure of the high pressure squeezing rollers is at least 4 kg. per cm. in the width direction of the warp sheet.

* * * * *